United States Patent [19]

Tsunemoto et al.

[11] 4,088,064

[45] May 9, 1978

[54] CONTROL APPARATUS

[75] Inventors: Shiro Tsunemoto, Edosaki; Teruki Mizuguchi; Eiichi Hirayama, both of Azuma, all of Japan

[73] Assignee: Fuji Plastic Co., Ltd., Tokyo, Japan

[21] Appl. No.: 565,546

[22] Filed: Apr. 7, 1975

[30] Foreign Application Priority Data

Apr. 10, 1974 Japan ..... 49-40475

[51] Int. Cl.[2] ..... F01B 31/14; F15B 15/24

[52] U.S. Cl. ..... 92/13.6; 92/161; 251/14; 251/60

[58] Field of Search ..... 92/13.41, 13.6, 13, 92/31, 161, 13.4, 13.5; 251/14, 60, 62, 63.4

[56] References Cited

U.S. PATENT DOCUMENTS

| | | | |
|---|---|---|---|
| 1,888,392 | 11/1932 | Penick et al. | 92/13.6 |
| 2,644,485 | 7/1953 | Schwendner | 251/14 |
| 2,646,074 | 7/1953 | Hopkins | 251/60 |
| 2,663,318 | 12/1953 | Lasko | 92/161 |
| 2,733,041 | 1/1956 | Crookston | 251/14 |
| 3,029,060 | 4/1962 | Anderson | 251/14 |
| 3,249,019 | 5/1966 | Seeloff | 92/13.6 |
| 3,334,648 | 8/1967 | Probst | 251/62 |
| 3,385,561 | 5/1968 | Whalen | 251/14 |
| 3,410,518 | 11/1968 | Carsten | 251/62 |
| 3,765,642 | 10/1973 | Nelson | 251/14 |
| 3,842,854 | 10/1974 | Wicke | 251/14 |
| 3,921,504 | 11/1975 | Mumford | 92/13.6 |

FOREIGN PATENT DOCUMENTS

| | | | |
|---|---|---|---|
| 861,665 | 2/1961 | United Kingdom | 251/14 |

*Primary Examiner*—Martin P. Schwadron
*Assistant Examiner*—Abraham Hershkovitz

[57] ABSTRACT

A control apparatus comprising a cylinder including therein a piston non-stepwise controllable in terms of the amount of piston portion protruded and the speed of its protruding movement. The amount of piston portion protruded is controlled by an attachment position at which the cylinder is attached to an adaptor for fastening the control apparatus to a device desired to be controlled and the position of a bar extended into the cylinder through one end portion thereof to abut against a piston head. The speed of protruding movement of the piston is controlled by a control fluid fed into and discharged from a cylinder chamber divided by the piston head into two parts.

2 Claims, 3 Drawing Figures

CONTROL APPARATUS

BACKGROUND OF THE INVENTION

This invention relates to a control apparatus, and more particularly to a piston type control apparatus whose piston operation is controlled by fluid means and/or mechanical means.

As an apparatus for controlling the pressure and/or flow quantity of a fluid flowing through a pipe-line a multivalve type control apparatus is well known which is so designed as to properly open and close valves disposed respectively in the pipes of a manifold system thereby to change over the flow course of a fluid flowing through these pipes thus to obtain a predetermined pressure and/or flow quantity of the fluid. In such control apparatus, however, when the valve opening and closing operation is performed, the pressure and/or flow quantity fail to obtain a stationary flow. Therefore, where this control apparatus is used in an oil pressure pipe-line for, for example, the injection ram of an injection machine, the unfree surface of a molded article becomes rough, or the free surface thereof becomes wavy. In addition, such control apparatus requires provision therein of many valves. As a result, the apparatus is made large in size and complicated in construction and high in cost. In addition, such control apparatus requires changeover of valves thus making its operation inconvenient. In addition, such control apparatus only enables the fluid to be set at a specific pressure and/or flow quantity, so that it is impossible to control the fluid non-stepwise.

Under these circumstances, as an apparatus for multistepwise controlling the fluid using a single valve a piston type control apparatus has been proposed which is so designed as to control the operation of a piston included therein using electromagnetic means. In such electromagnetic control apparatus, current is passed through a solenoid to excite the magnetic core, and its attractive force is designed to control the piston position. This control apparatus makes a continuous non-stepwise remote operation possible, but fails to completely prevent occurrence of the pulsation constituting a drawback inherent to an electromagnetic device, so that a stationary flow is not obtained. In addition, such control apparatus requires provision therefor of constant voltage means in particular, and as a result is made expensive and complicated in construction. In addition, such control apparatus has also the drawback that it is difficult to control the speed of the piston movement.

SUMMARY OF THE INVENTION

An object of the invention is to provide a control apparatus which is simple in construction and inexpensive and makes a stable non-stepwise operation possible.

Another object of the invention is to provide a control apparatus in which the amount of piston portion protruded and the speed of protruding movement of the piston are capable of being controlled mechanically and fluidly, respectively.

A further object of the invention is to provide a control apparatus in which the extreme positions of the piston are capable of being determined easily and reliably.

A further object of the invention is to provide a control apparatus which is capable of being readily mounted on a known device.

For achieving the above objects, the control apparatus according to the invention comprises a cylinder having a chamber and bored radially with a pair of apertures for permitting control fluid to be fed therethrough into and discharged therethrough from the chamber, a piston having a rod outwardly projected from the cylinder through one closed end thereof and a head in integrity with the rod capable of being axially reciprocatingly moved between the apertures and disposed within the cylinder, control means insertable into the cylinder through the other closed end thereof so as to control the reciprocating movement of the piston, and fastening means for fixedly mounting the cylinder.

The above and further objects and novel features of the invention will more fully appear from the following detailed description when the same is read in connection with the accompanying drawings. It is to be expressly understood, however, that the drawings are for the purpose of illustration only and are not intended as a definition of the limits of the invention.

DETAILED DESCRIPTION OF THE PREFERRED EMBODIMENTS

Figure 1:
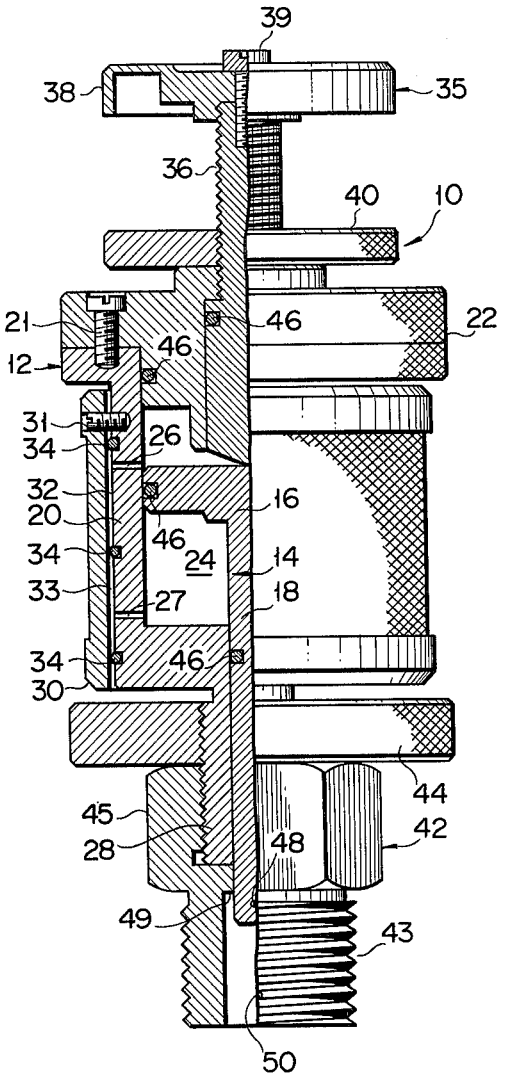
FIG. 1 illustrates a control apparatus according to a preferred embodiment of the invention in which the piston is situated at its upper extreme position, with the left half of the apparatus in section.

The accompanying drawings illustrate preferred embodiments of the invention and throughout the drawings the same parts and sections are denoted by the same reference numerals.

As illustrated in FIG. 1, a control apparatus 10 comprises a cylinder 12 including therein a piston 14 having a piston rod 18 and a piston head 16 formed in integrity therewith. The cylinder 12 comprises a body 20 opened at one end and a cover 22 fixed by a screw 21 to the body 20 to close the open end thereof, said body 20 and said cover 22 defining a chamber 24. The body 20 comprises a side wall bored with a pair of apertures 26, 27 for feeding and discharging a control fluid into and from the chamber 24, and an integral closed end from which is projected a cylindrical guiding portion 28 for supporting and guiding the piston rod 18. An outer shell member 30 is disposed outside rendered the body 20 in a manner spaced from and concentric with the same, and sealed annular spaces 32, 33 are defined by O-rings 34 set in the side wall of the body 20.

A reference numeral 35 designates control means for controlling the reciprocating movement of the piston 14 through adjusting its, one extreme position. This control means 35 comprises a bar 36 screwed into a threaded hole of the cover 22 and extending into the chamber 24 of the cylinder 12, a rotatable operating member 38 such as a manually operable handle wheel fixed by a screw 39 to the bar 36 and intended to move the bar 36, and a holding nut 40 for holding in place the bar 36 precisely at its adjusted position.

The guiding portion 28 of the cylinder body 20 is screwed into a threaded hole formed in an adaptor 42 and is precisely held in place by a holding nut 44. The adaptor 42 comprises an externally threaded portion 43 for mounting the apparatus 10 and a driving portion 45 having, for example, a hexagonal shape for rotating the adaptor 42.

O-rings 46 are provided for the purpose of securing the airtight condition of the chamber 24. To the tip end portion of the piston rod 18 is attached a pin 48 for preventing the piston rod from being drawn off. The adaptor 42 is provided with a shoulder 49 to abut against the pin 48 and an aperture 50 for pin attachment.

There will now be described the operation of the control apparatus 10 having such a construction as illustrated in FIG. 1. The apparatus 10 is mounted on a device desired to be controlled such as a relief valve by rotating the hexagonal drive portion 45 of the adaptor 42 and fitting the externally threaded portion 43 thereof into a corresponding threaded hole of said device by screw engagement. The position at which the cylinder 12 is fitted to the adaptor 42 is determined through the screwing of the cylinder 12, and is precisely secured by screwing the holding nut 44 over the guiding portion 28 of the cylinder 12 to allow it to abut against the adaptor 42. The cylinder 12 is screwed into the adaptor 42 by being rotated with the outer shell member 30 kept at a non-rotational condition. At this time, the outer shell member 30 is axially slided, and is secured by a screw 31 to the cylinder 12 for the purpose of being prevented from falling off. It will be readily understood that if the cylinder 12 is determined with precision at a prescribed position, the lower end position, i.e., the maximum protruded position of the piston rod 18 will also be determined. Further, the upper end position, i.e., the raised position of the piston rod 18 is precisely and variably determined by the holding nut 40 through rotating the handle wheel 38 and axially moving the bar 36. A change in the position of the lower end of bar 36 causes a corresponding change in the stroke of piston 12 within chamber 24 since the piston abuts against the lower end of bar 36 at the upper end of its stroke. Such variation in the stroke of the piston causes a corresponding variation in how far the lower end of piston rod 18 protrudes, and this variation may be used to regulate the relief valve or other article to be controlled. The speed of the reciprocating movement of the piston 12 can be freely controlled by adjusting the quantity of control fluid fed into and discharged from the chamber by actuators (not shown) through the annular space 32 or 33 and the corresponding aperture 26 or 37. Because of its small shrinkability, oil is preferred as the control fluid to air. Preferably, the cylinder 12, cover 22, outer shell member 30 and holding nuts 40, 44 are formed with knurlings at their respective outer surfaces so as to cause their holding and rotating operations to become easy.

Figure 2:
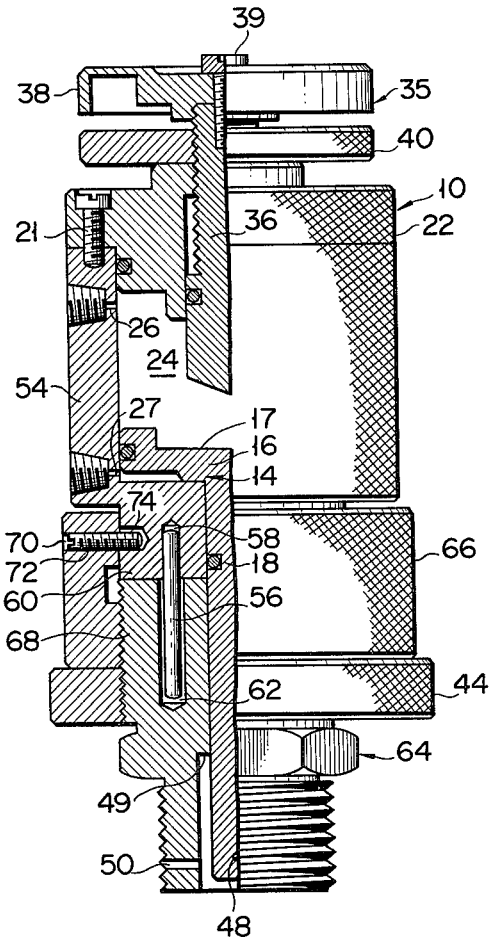
FIG. 2 illustrates a control apparatus according to another preferred embodiment of the invention in which the piston is situated at its lower extreme position, with the left half of the apparatus in section.

FIG. 2 illustrates another preferred embodiment of the invention different from the embodiment illustrated in FIG. 1 in respect of its connecting means for connecting the cylinder to the adaptor.

A cylinder 54 of the control apparatus 10 illustrated in FIG. 2 is connected to an adaptor 64 through a pin 56 fixedly inserted under pressure into an axial hole 58 axially formed in a guiding portion 60 of the cylinder 54 and slidable within a corresponding axial hole 62 of the adaptor 64, a coupling 66 fitted by screw engagement over an externally threaded portion 68 formed at the cylinder side end section of the adaptor 64, and a set screw 70 fitted by screw engagment into a threaded hole 72 radially formed in the coupling 66 and inserted into an annular groove 74 formed in the outer peripheral surface of the guiding portion 60, said annular groove 74 having a width greater than the diameter of said hole 72. Since the control apparatus 10 illustrated in FIG. 2 has the foregoing construction, that portion of the set screw 70 which is inserted into the annular groove 74, when the coupling 66 is rotated, is caused to press the upper or lower end face of the groove 74 while being rotated within the groove 74 therealong. As a result, the cylinder 54 is axially moved while causing the pin 56 to slide within the hole 62. Namely, the cylinder 54 can axially freely be positioned without making a self-rotation. After the cylinder 54 has been positioned by rotating the coupling 66, the holding nut 44 is allowed to abut against the coupling 66 so as to maintain the cylinder 54 precisely at that position. Accordingly, actuators (not shown) can directly be fitted to the cylinder 54, so that there is no need of providing the outer shell member 30 and O-rings 34 employed in the embodiment illustrated in FIG. 1.

The pin 56 may be forced into the axial hole 62 of the adaptor and rendered slidable within the hole 58 of the cylinder 54, and it will be easily understood that the pin 56 can be fixed by other means than said forcing method. From the foregoing description, it is apparent that rotation of coupling 66 while adaptor 64 is held stationary causes the lower threaded part of the coupling which is meshed with the threaded portion 68 of the adaptor 64 to rotate relative to threaded portion 68. This relative rotational movement causes an axial movement of the coupling 66 relative to the adaptor. Since cylinder 54 is connected to the coupling via the set screw 70 projecting into groove 74, cylinder 54 moves axially with the coupling. During axial movement of cylinder 54 it is prevented from rotating due to the pin 56 which connects the cylinder to the stationary adaptor 64. Further, if, as illustrated in FIG. 2, the piston head 16 is formed with a circular groove 17, the entire length of the apparatus 10 can be reduced. Further, a compressive coil spring can be disposed at either or both of the upper and lower faces of the piston head 16 so as to supplement the piston pressing force of the control fluid. In this case, the groove 17 can be utilized as a spring attachment seat as well.

The FIG. 2 embodiment operates substantially like that of FIG. 1 in that changes in the speed and stroke of the piston with corresponding changes in the position of protuding end 48 perform a control function in the article being controlled, for example, a relief valve. In all embodiments of the invention, the protuding lower end of bar 36, whose position can be varied via the wheel 38, forms an upper limit for the stroke of the piston.

Figure 3:
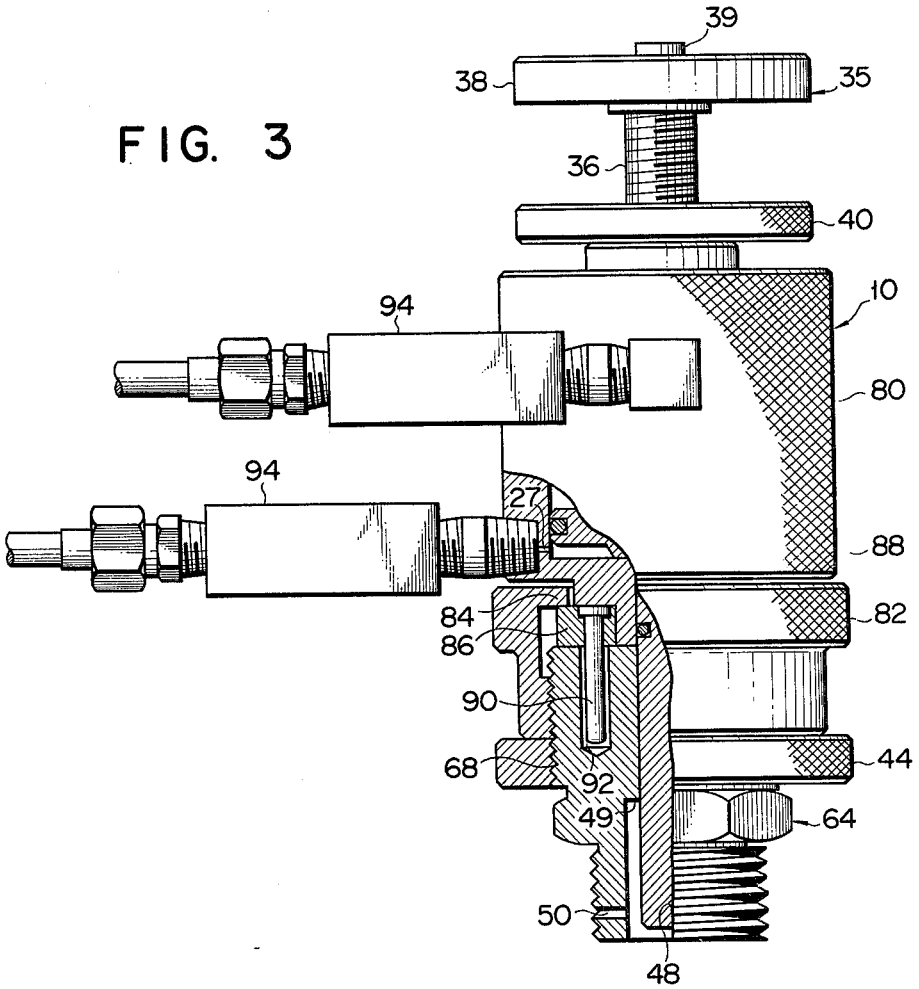
FIG. 3 illustrates a control apparatus according to another preferred embodiment of the invention to which actuators for control fluid are attached, with part of the apparatus in section.

FIG. 3 illustrates another preferred embodiment of the invention different from the two proceding preferred embodiments in respect of its connecting means for connecting the cylinder to the adaptor.

In the control apparatus 10 illustrated in FIG. 3, a cylinder 80 is connected to an adaptor 64 through a coupling 82 screwed over the externally threaded portion 68 of the adaptor 64, for example, an annular portion 84 projected inwardly from the coupling 82, a ring member 86 fixed by screws (not shown) to a guiding portion 88 of the cylinder 80, and a pin 90 with a large diameter head fixed to the ring member 86 and slidable within an axial hole 92 formed in the adaptor 64. Similarly to the embodiment illustrated in FIG. 2, accordingly, this control apparatus 10 also permits the cylinder 80 to be easily axially moved by rotation of the coupling 82, without rotating the cylinder 80. Preferably, a pair of apertures 26, 27 (but the aperture 26 is not shown) are provided spaced at 90° from each other as illustrated in FIG. 3. This is because the attchment of the actuators 94 to the cylinder 20 becomes easy. With respect to the actuator 94, if the one having changing-over means is employed, it will have only to be provided in a number of 1. Further, employment of an actuator taking the form of an air-oil converter would be preferable in terms of its operability.

It will be easily understood that the control apparatus can be readily multi-staged by providing between the cover and the cylinder one or more cylinders each including therein another similar piston. Further, if the bar is interlockingly connected to a pulse motor in lieu of providing the manual handle wheel for moving the bar in order to determine the upper limit of the piston movement, it will be able to be positioned automatically and remotely.

Accordingly, if the control apparatus of the invention in lieu of, for example, the conventional wheel type pressure controller is mounted on a pressure control valve such as the relief valve, the operating pressure of a pilot valve included in the pressure control valve can be varied non-stepwise through varying the urging force of the pilot adjusting spring by varying the amount of piston portion protruded. Further, if the present control apparatus is used in a flow control valve, transfer valve or the like, the flow quantity and the flow path can be varied non-stepwise. Furthermore, the present control apparatus is not limited to use in the aforesaid valve devices but can be applied to a device requiring a position control, for example, an automatic machine such as an automatic lathe, automatic assembling machine or the like. Thus, it will be understood that the present control apparatus can be applied in a wide variety of fields.

The previously mentioned embodiments are simply for the purpose of explaining the control apparatus according to the invention, and this control apparatus can of course be modified in a variety of ways without departing from the object and scope of the invention.

What we claim is:

1. An improved control apparatus, comprising:

a cylinder having one end closed to form a chamber and provided with a pair of apertures apart from each other in the axial direction of the cylinder, a control fluid being introduced into and discharged from the chamber through said apertures;

a piston having a head movable within the chamber in its axial direction between the pair of apertures, and a rod integral with the head, said rod extending outward through the bottom of the cylinder;

control means variably extending inside the chamber through the closed one end, the sliding motion of the piston head being defined by the control means and the bottom of the cylinder; an adaptor for fixedly mounting the control apparatus to a member to be controlled; said adaptor having an externally threaded part formed at one end thereof;

coupling means for connecting the cylinder to the adaptor, said coupling means being rotated to move the cylinder in its axial direction without rotating the cylinder and having an internally threaded annular part formed at one end thereof and meshing annularly around the externally threaded part of the adaptor;

the coupling means having first connecting means provided round the outer circumference of the cylinder and being capable to abut the cylinder, the rotation of the first connecting means serving to move the cylinder in its axial direction;

rotation preventing means to prevent rotation of said adaptor and said cylinder during rotation of said coupling means, said rotation preventing means including second connecting means permitting the cylinder to move in its axial direction relative to the adaptor;

the cylinder having an annular groove formed along the outer circumference thereof, the first connecting means having an indwardly projected member engaged with the annular groove; the second connecting means having a pin whose one end is fixed to one of the cylinder and the adaptor with the other end slidable along an axial hole bored in the other member; the inwardly projected member of the first connecting means having an element engaged with the annular groove of the cylinder via a radial hole bored through the coupling means, and the pin of the second connecting means being fixed to one of the cylinder and the adaptor by forcedly inserting the pin into an axial hole provided therein.

2. The improved control apparatus according to claim 1, wherein the adaptor has a lock member for accurately locking the coupling means to the adaptor.

* * * * *